US010737372B2

(12) United States Patent
Arai et al.

(10) Patent No.: US 10,737,372 B2
(45) Date of Patent: Aug. 11, 2020

(54) SUCCESSIVE SCREW TIGHTENING MACHINE AND SCREW ROPE FOR USE THEREWITH

(71) Applicant: MURO CORPORATION, Utsunomiya (JP)

(72) Inventors: Kunihiro Arai, Utsunomiya (JP); Tomiaki Ochiai, Utsunomiya (JP)

(73) Assignee: MURO CORPORATION, Utsunomiya (JP)

( * ) Notice: Subject to any disclaimer, the term of this patent is extended or adjusted under 35 U.S.C. 154(b) by 36 days.

(21) Appl. No.: 15/841,969

(22) Filed: Dec. 14, 2017

(65) Prior Publication Data

US 2018/0178358 A1 Jun. 28, 2018

(30) Foreign Application Priority Data

Dec. 22, 2016 (JP) ..... 2016-249783

(51) Int. Cl.
*B25B 23/04* (2006.01)

(52) U.S. Cl.
CPC ..... *B25B 23/045* (2013.01)

(58) Field of Classification Search
CPC ..... B25B 23/045
USPC ..... 81/434; 206/340, 341, 345, 347
See application file for complete search history.

(56) References Cited

U.S. PATENT DOCUMENTS 3,554,246 A * 1/1971 Halstead ..... B25B 23/045 206/345
6,055,891 A * 5/2000 Habermehl ..... B25B 23/045 227/136
6,109,144 A * 8/2000 Muro ..... B25B 23/045 81/434
8,820,198 B2 * 9/2014 Park ..... B25B 23/045 81/435

(Continued)

FOREIGN PATENT DOCUMENTS

DE 102011075094 A1 8/2012
DE 102014005105 A1 8/2015

(Continued)

OTHER PUBLICATIONS

English translation for publication JP09-136269A, Total of 19 pages.

(Continued)

*Primary Examiner* — Hadi Shakeri
(74) *Attorney, Agent, or Firm* — R. Lynette Wylie; Apex Juris, Pllc.

(57) ABSTRACT

A screw rope is configured to hold fixed portions of threaded parts of respective screws so as to be obliquely disposed at predetermined parallel intervals and at a predetermined inclination angle by a belt-shaped member which runs in a length direction and binding strips which are provided on the rear surface side of the belt-shaped member at predetermined intervals, to continuously form a guide groove on the front surface side of the belt-shaped member along a length direction thereof, to dispose many upper recessed parts at a (Continued)

position above the guide groove in a scattered state and over the entire length on the front surface side of the belt-shaped member and to dispose many lower recessed parts at a position under the guide groove in the scattered state and over the entire length.

2 Claims, 15 Drawing Sheets

(56) References Cited

U.S. PATENT DOCUMENTS

| | | | | |
|---|---|---|---|---|
| 8,893,943 | B2 * | 11/2014 | Wywialowski | B25B 23/045 227/120 |
| 2012/0318108 | A1 * | 12/2012 | Kieber | B25B 21/00 81/434 |

FOREIGN PATENT DOCUMENTS

| | | | |
|---|---|---|---|
| EP | 2295821 | A2 | 3/2011 |
| GB | 2309186 | A | 7/1997 |
| JP | 09-136269 | A | 5/1997 |

OTHER PUBLICATIONS

Extended European search report for EP17203421.7, dated May 22, 2018, Total of 11 pages.

* cited by examiner

Prior Art

SUCCESSIVE SCREW TIGHTENING MACHINE AND SCREW ROPE FOR USE THEREWITH

CROSS REFERENCE TO RELATED APPLICATIONS

This patent application claims the benefit of Japan Patent Application Ser. No. 2016-249783, filed on Dec. 22, 2016, which is incorporated herein by reference.

BACKGROUND OF THE INVENTION

(1) Technical Field

The present invention relates to a screw rope (commercially identified by the registered trademark "VISROPE") for use in a successive screw tightening machine.

(2) Description of Related Art

There is proposed a successive screw tightening machine of the type of successively tightening the screws in order to fix plate materials such as, for example, a wood plate, a metal plate, a gypsum board and so forth to a floor surface or a wall surface.

There is proposed a successive screw tightening machine which is configured such that a driver is built in a tightening machine body with a grip handle being formed, a screw tightening bit is detachably coupled to the driver, a screw feeding mechanism body is attached to a front part of the tightening machine body so as to freely slide in a front-back direction, the bit is rotatably inserted into the screw feeding mechanism body, a tightening depth adjusting mechanism for adjusting the tightening depth of the screw by the bit is configured on the tightening machine body, a screw feeding machine which sequentially feeds respective screws on a screw rope that many screws are attached to a belt-shaped member side by side to a position of a tightening action by the bit in linkage with forth-back sliding movement of the screw feeding mechanism body in association with a tightening operation by the bit is configured on the screw feeding mechanism body, and a leading end block that an abutment surface is disposed in a projected state is configured on the screw feeding mechanism body so as to be fixed to a desirable position in the front-back direction relative to the screw feeding mechanism body, for example, in Japanese Unexamined Patent Application Publication No. Hei9-136269.

In case of a screw rope 101 in the successive screw tightening machine disclosed in Japanese Unexamined Patent Application Publication No. Hei9-136269, as illustrated in FIG. 17 and FIG. 18, the screw rope 102 is configured by a simple structure that many screws S are held side by side by a belt-shaped member 102 and binding strips 103 on a side surface of the belt-shaped member 102 at predetermined intervals and in arrangement orthogonal to the belt-shaped member 102. In addition, the screw feeding mechanism of the successive screw tightening machine disclosed in Japanese Unexamined Patent Application Publication No. Hei9-136269 is configured so as to feed out the respective screw S held by the screw rope 101 to the tightening action position while sequentially moving the screws S in parallel in linkage with forth-back sliding movement of the screw feeding mechanism body in association with the tightening operation by the bit.

In most of other various successive screw tightening machines which are being practically used now, configurations of screw ropes thereof and configurations of screw feeding mechanisms thereof are the same as those of the above-mentioned successive screw tightening machine disclosed in Japanese Unexamined Patent Application Publication No. Hei9-136269.

Under the existing circumstances, in a case where a specific successive screw tightening machine is used, it is requested to set the coupling pitch of the screws in conformity with diameters of screw heads in order to allow use of the screw rope with many screws being mounted in the tightening machine, then when the coupling pitch of the screws is fixed, the number of the kinds of the screws adaptable to this fixed coupling pitch is limited, depending on the shapes of screw heads, and, therefore, the number of the kinds of the screws that can be used is more limited. Further, application for tightening a member originally having no specific preformed hole to be tightened, it is difficult to adaptably target the position of a tip hole in tightened members of highly variable configurations in the screw rope.

BRIEF SUMMARY OF THE INVENTION

The present invention has been made in view of the above mentioned existing circumstances and aims to provide a screw rope for use in the successive screw tightening machine configured to suppress the limitation on coupling pitch of the screws caused by the difference in diameter among screw heads, to suppress the restriction on shapes of the target screw heads (the screw heads to be handled in the above-mentioned successive screw tightening machine) regardless of the outer shape, the thickness and so forth of each screw head and thereby to make it possible to increase the number of kinds of target screws used and to perform driving targeting on, for example, the tip hole position of the tightened member, when the successive screw tightening machine is used for tightening by using the screw rope with many screws being mounted.

According to one embodiment of the present invention, there is provided a screw rope for use in a successive screw tightening machine including a grip unit in which a screw tightening bit is disposed so as to project therefrom and which rotationally drives the bit by switch operation and a clutch, a screw tightening machine body unit which is disposed under the grip unit and supports the grip unit to be movable downward and upward, includes a feeder block which makes a leading end of the bit face a tightening action position and is disposed on the lateral side of the tightening action position and a guide cover which is disposed so as to face the feeder block thereby to guide a plurality of screws supported by the screw rope to the tightening action position side between the feeder block and the guide cover and successively tighten the screws to underlying tightening object spots, and also includes a guide projection part for guidance of the screw rope which is formed on one side of a wall surface of the guide cover along which the screw rope is guided and is formed into an inclined shape which lowers toward the side of a feeding destination of the screw rope, and a magazine unit which feeds in turn many screws held by the screw rope, in which the screw rope is configured to hold fixed portions of threaded parts of the respective screws so as to be obliquely disposed at predetermined parallel intervals and at a predetermined inclination angle corresponding to an inclination angle of the guide projection part by a belt-shaped member which runs in a length direction and binding strips which are provided on the rear surface side of the belt-shaped member at predetermined intervals and to continuously form a guide groove on the front surface side of the belt-shaped member along a length direction thereof, and the screw rope is configured such that when the screw rope is used, the screws are guided to the tightening action position in turn in a manner that height positions of screw heads of the respective screws are lowered as the screws approach the tightening action position side of the bit while keeping the screw rope in an inclined state and keeping the respective screws in vertical states by engagement of the guide projection part of the guide cover with the geode groove in the screw rope.

According to the invention described and claimed herein, it is possible to realize and provide the screw rope for use in the successive screw tightening machine which is able to function as the screw rope for the specific successive screw tightening machine and makes it possible to reduce the restrictions on the size of the head diameter and the shape of each screw and to increase freedom of selection of the kind of the screw used.

In addition, since many recessed parts are disposed at the position other than that of the guide groove in the length direction of the belt-shaped member in the scattered state and over the entire length, bending the guide groove when winding the screw rope into a coiled shape enables use in the successive screw tightening machine for successive insertion of many screws of various sizes including a large heads.

In addition, using the belt-shaped member having an upper recessed part and a lower recessed part on both sides of the guide groove provides a bending balance between the upper and lower sides of the guide groove when winding the screw rope into the coiled shape imparting a curvature to the screw rope for use in the successive screw tightening machine for successive insertion of many screws of various sizes and with large heads.

DETAILED DESCRIPTION OF THE INVENTION

Figure 1:
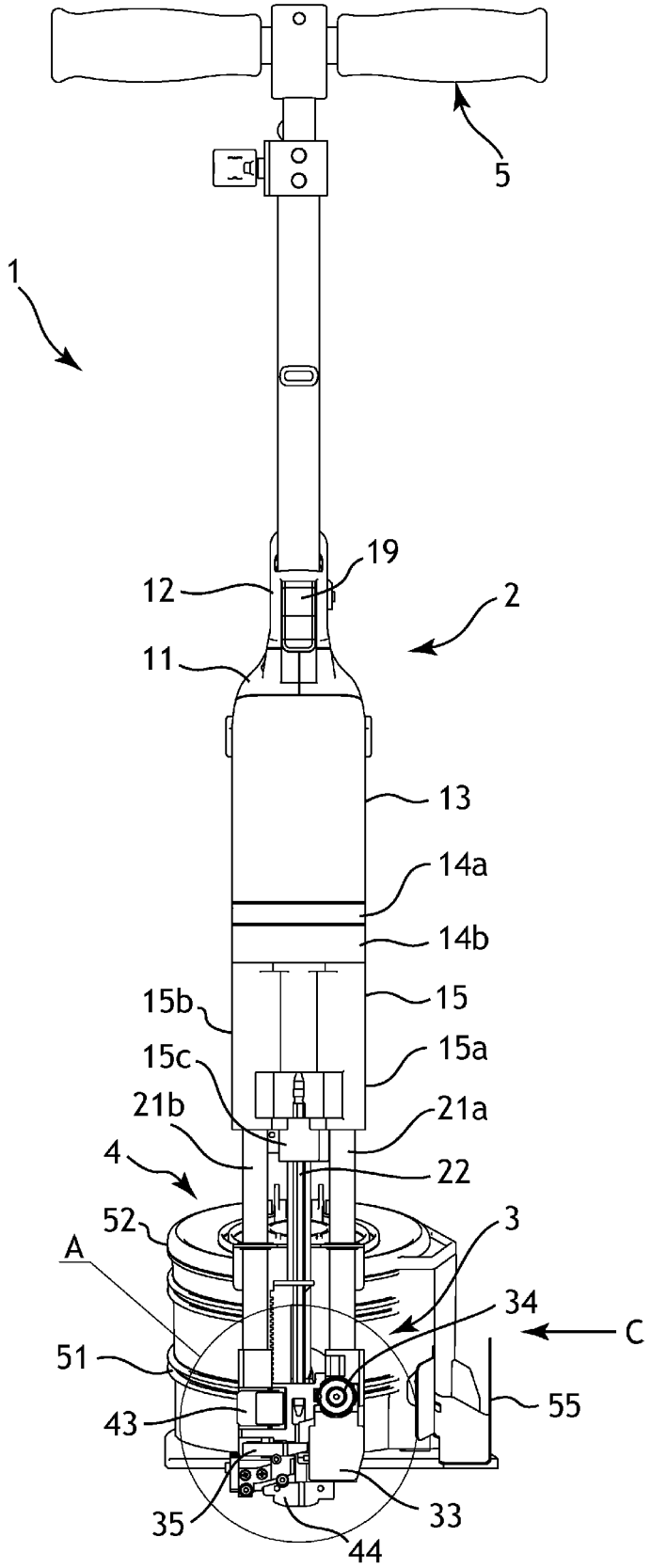
FIG. 1 is a schematic perspective view illustrating one example of a general configuration of a successive screw tightening machine in which a screw rope according to one embodiment of the present invention is used, viewed from the front surface side thereof.

The present invention provides a screw rope for use in successive screw tightening machine which is configured to suppress the limitation on coupling pitch of the screws caused by the difference in diameter among screw heads, to suppress the restriction on shapes of the target screw heads of the subject successive screw tightening machine regardless of the outer shape, the thickness and so forth of each screw head and thereby to make it possible to increase the number of configurations and sizes of target screws that can be driven thereby. For example, when the successive screw tightening machine is used for tightening by using the screw rope with many screws being mounted, a tip hole position of a tightened member imparts a configuration wherein the grip unit in which the screw tightening bit is disposed projects therefrom and rotationally drives the bit by switch operation employing a clutch so that the screw tightening machine body unit disposed under and thus supports the grip unit so it is movable downward and upward. The present invention includes the feeder block at the leading end of the bit face disposed on the lateral side at a tightening position where tightening action is provided and a guide cover is disposed so as to face the feeder block to thereby guide the plurality of screws supported by the screw rope toward the tightening action position side between the feeder block and the guide cover and thereby successively clamp the screws to underlying tightening object spots. The present invention further includes the guide projection part for guidance of the screw rope which is formed on one side of the wall surface of the guide cover along which the screw rope is guided and is formed into the inclined shape which lowers toward the side of a feeding destination of the screw rope, and the magazine unit which feeds in turn many screws held by the screw rope, in which the screw rope is configured to hold the fixed portions of the threaded parts of the respective screws so as to be obliquely disposed at predetermined parallel intervals and at the predetermined inclination angle corresponding to the inclination angle of the guide projection part by the belt-shaped member which runs in the length direction and binding strips which are provided on the rear surface side of the belt-shaped member at predetermined intervals and to continuously form the guide groove on the front surface side of the belt-shaped member along the length direction thereof. Thus, the screw rope according to the present invention is configured such that the screws are guided to the tightening action position in turn in a manner that height positions of the screw heads of the respective screws are lowered as the screws approach the tightening action position side of the bit while keeping the screw rope in the inclined state and keeping the respective screws in the vertical states by engagement of the guide projection part of the guide cover with the geode groove in the screw rope.

Embodiment

In the following, a screw rope for use in successive screw tightening machine according to one embodiment of the present invention will be described in detail with reference to the drawings.

The successive screw tightening machine 1 has the same configuration as the successive screw tightening machine which is disclosed in Japanese Patent Application No. 2016-090793 that the applicant filed prior to the present application In the following, the successive screw tightening machine 1 and screw rope 6 for use therewith of the preset invention will be described in detail.

The successive screw tightening machine 1 in which the later described screw rope 6 according to the present embodiment is used includes a grip unit 2 that an operator of the successive screw tightening machine 1 grips with one hand and pushes down in order to rotationally drive a bit 22 which is projected downward and to clamp a screw S to a target place, a screw tightening machine body unit 3 which is disposed under the grip unit 2 and clamps the screw S to the target place by utilizing rotation force by the bit 22, a magazine unit 4 which is detachably disposed on a rear part of the screw tightening machine body unit 3 and feeds in turn many screws S held by the screw rope 6 according to the present embodiment which will be described in detail later to the screw tightening machine body unit 3, and a handle unit 5 which is disposed above the grip unit 2 and is configured to be freely inserted into and removed from the grip unit 2 and to be adjustable in height and that the operator of the successive screw tightening machine 1 grips with both hands (or one hand) to operate it as illustrated in FIG. 1 to FIG. 3, and FIG. 14.

In the successive screw tightening machine 1, the handle unit 5 is not a requisite configuration and is configured to be freely attached to and detached from the upper part of the grid unit 2.

Whether the successive screw tightening machine 1 is used with the handle unit 5 being mounted or not is optional.

The bit 22 is a member corresponding to a standard driver and is configured to include a shaft which is hexagonal in sectional shape. Engagement projection parts, each of which engages with an engagement groove such as, for example, a plus groove formed in a screw head, are formed on both ends of the bit 22 and a meshing groove is formed in the vicinity of each engagement projection part in a circumferential direction.

The grip unit 2 includes a handle cover 11 of a two-sheet structure of front and rear sheets which forms a space into which the operator inserts one hand and grips the grip unit 2, an end cover 12 which covers over the handle cover 11, a cylindrical housing 13 which is disposed under the handle cover 11, a first lower cover 14*a* and a second lower cover 14*b* which are additionally disposed in turn under the housing 13, a block head 15 which is further additionally disposed under the second lower cover 14*b* and so forth.

A trigger switch 16 which is used for starting or stopping rotation of a rotational drive source (not illustrated) which rotationally drives the bit 22 is disposed on the lower surface side of the end cover 12 and a direction lever 17 for rotating the rotational drive source forward or reversely is attached to a position next to the trigger switch 16.

The trigger switch 16 and the direction lever 17 are configured integrally with each other so as to prevent accidental switching between forward rotation and reverse rotation.

In addition, a handle unit insertion port 18 into which the lower-end side of the handle unit 5 is inserted is disposed on the front-part side of the end cover 12 and a handle unit lock lever 19 which fixes the handle unit 5 to the grip unit 2 itself or releases fixing of the handle unit 5 is disposed on the front part of the handle cover 11.

Figure 2:
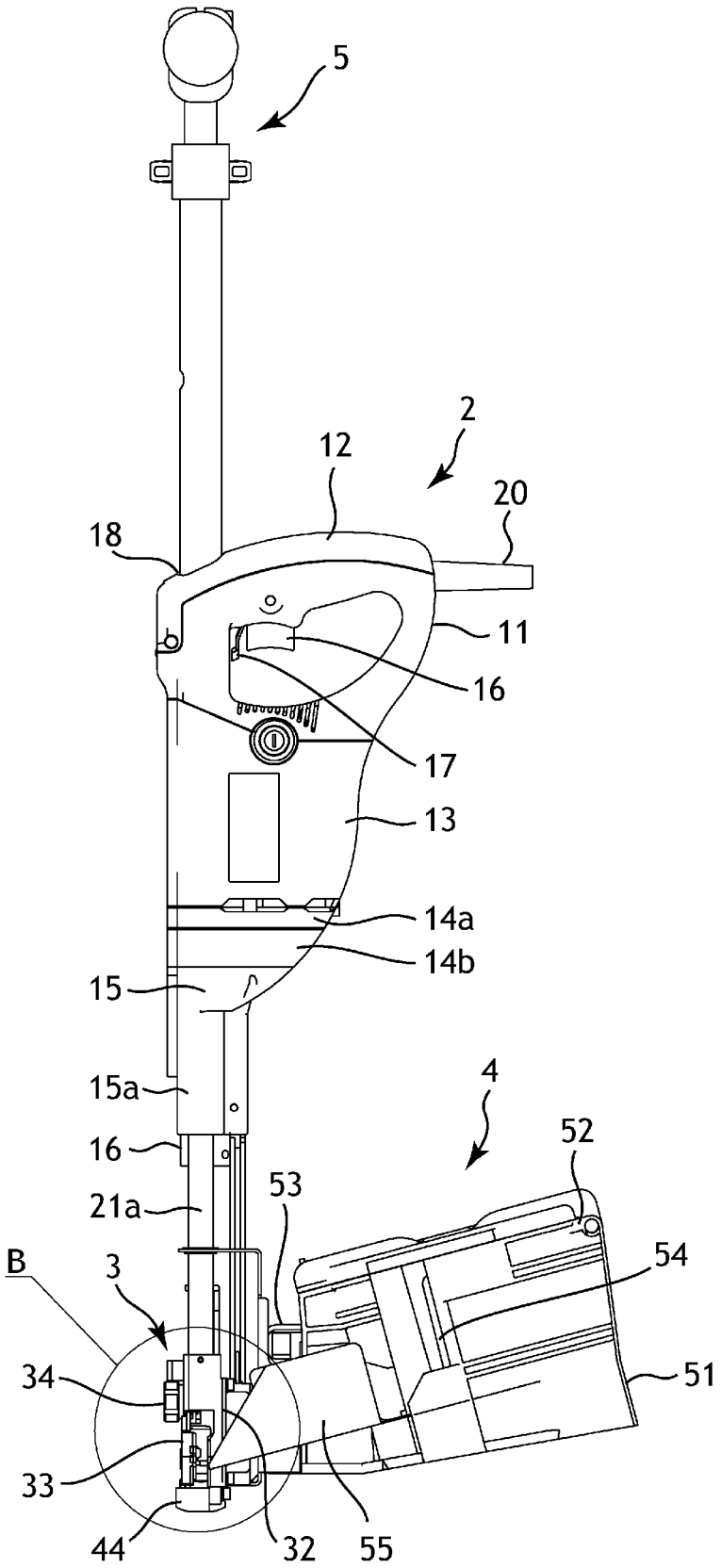
FIG. 2 is a schematic perspective view illustrating one example of the general configuration of the successive screw tightening machine in which the screw rope according to the present embodiment is used, viewed from the side surface side thereof.
Figure 3:
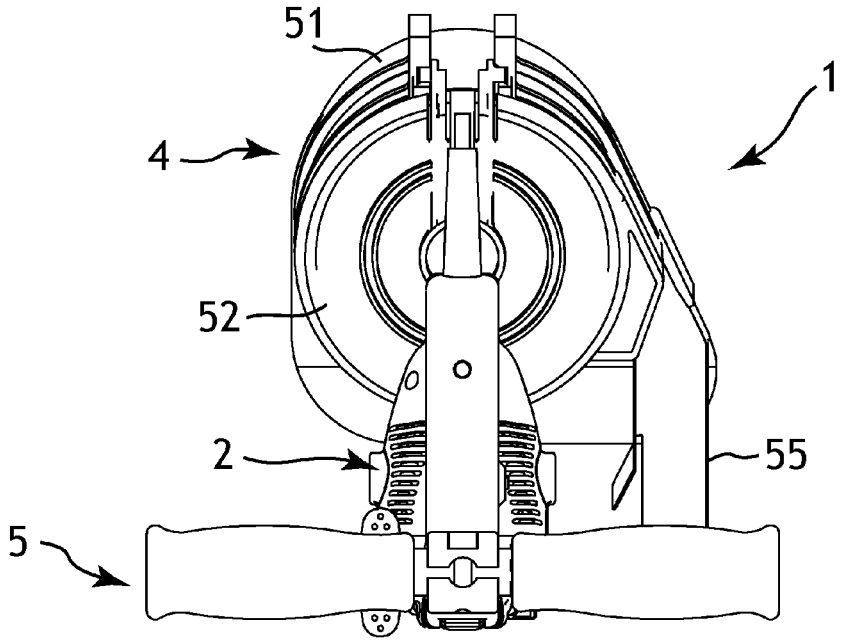
FIG. 3 is a schematic perspective view illustrating one example of the general configuration of the successive screw tightening machine in which the screw rope according to the present embodiment is used, viewed from the upper surface side thereof.
Figure 4:
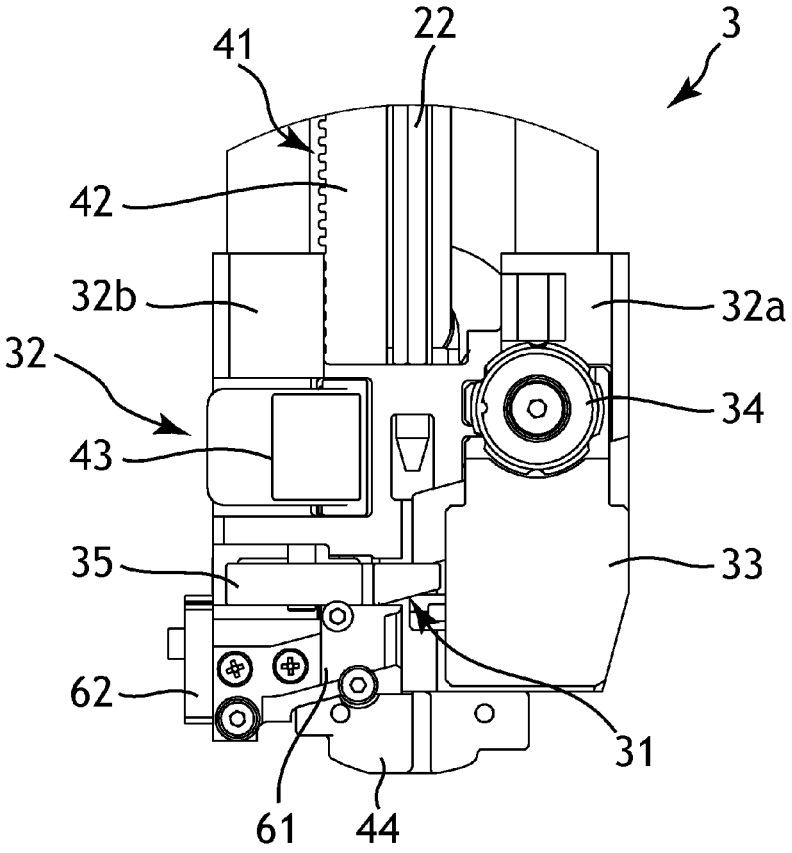
FIG. 4 is a schematic enlarged diagram illustrating one example of a part A in FIG. 1.
Figure 5:
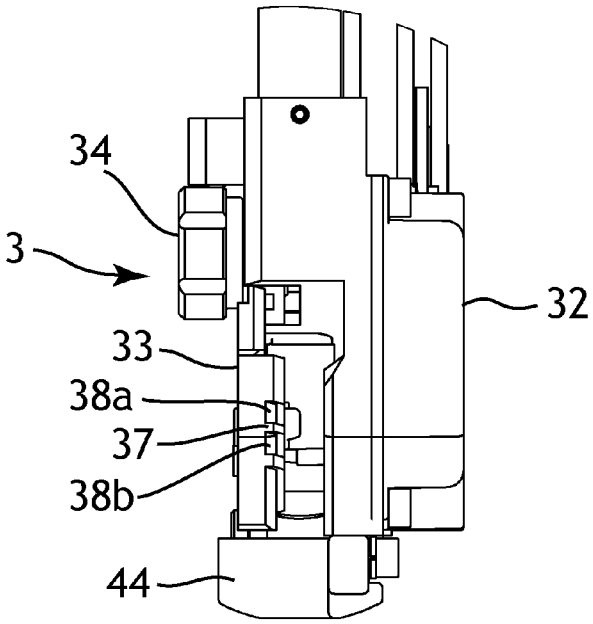
FIG. 5 is a partial enlarged diagram illustrating one example of a screw tightening machine body unit, viewed from the arrow C side in FIG. 1.
Figure 6:
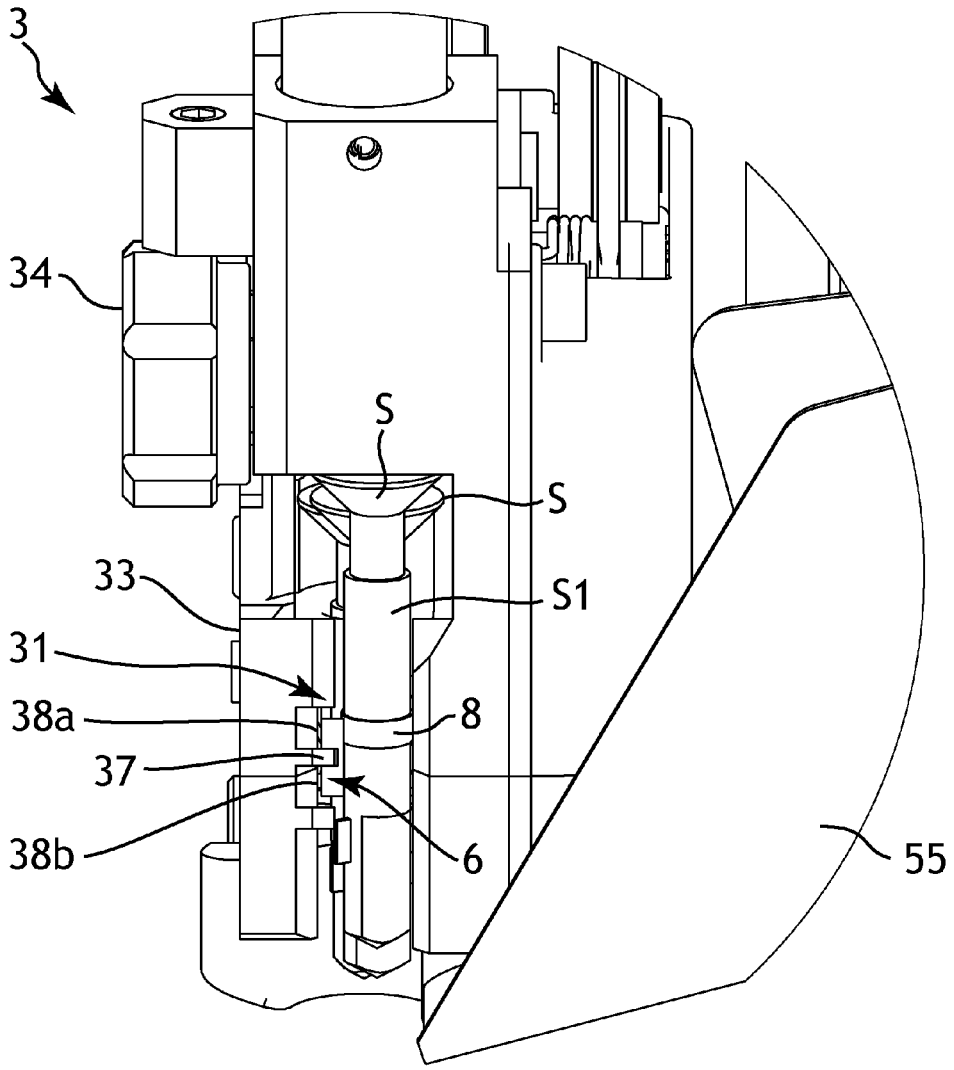
FIG. 6 is a schematic enlarged diagram illustrating one example of a part B in FIG. 2.
Figure 7:
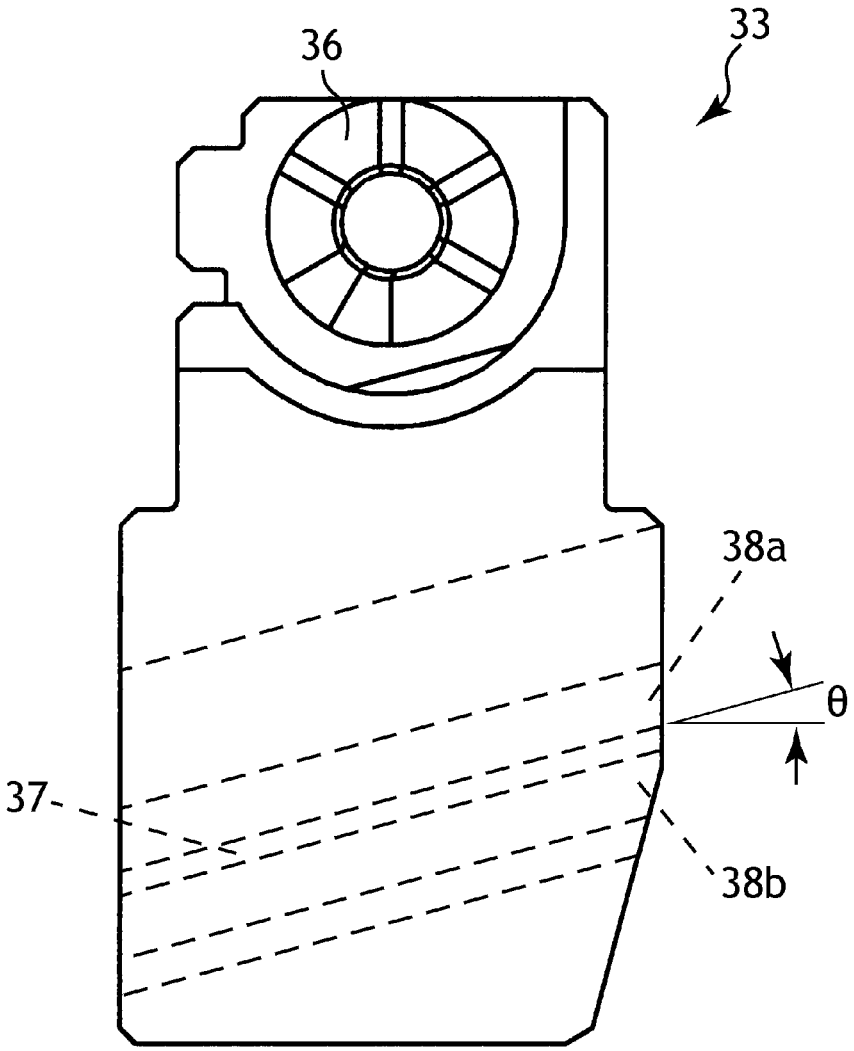
FIG. 7 is a schematic enlarged front view illustrating one example of a guide cover which configures the screw tightening machine body unit in which the screw rope according to the present embodiment is used.
Figure 8:
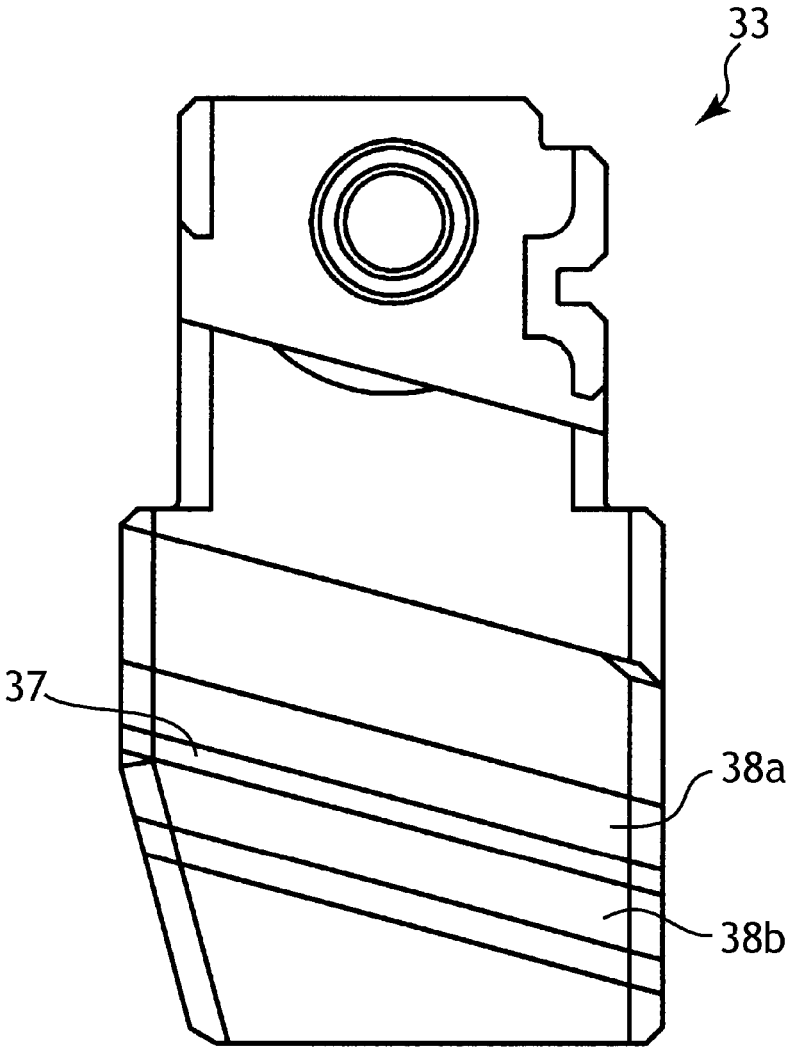
FIG. 8 is a schematic enlarged rear view illustrating one example of the guide cover which configures the screw tightening machine body unit in which the screw rope according to the present embodiment is used.
Figure 9:
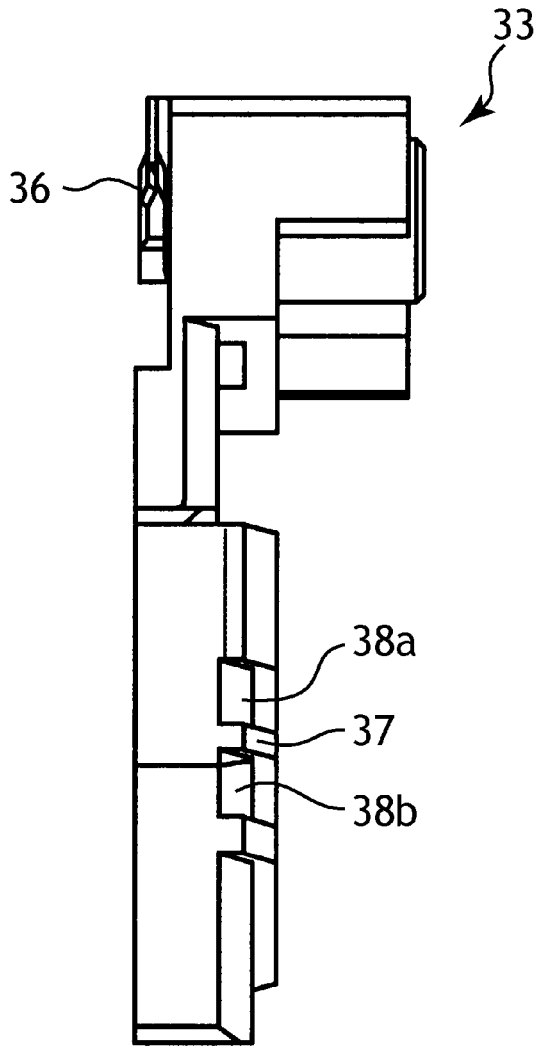
FIG. 9 is a schematic enlarged side view illustrating one example of the guide cover which configures the screw tightening machine body unit in which the screw rope according to the present embodiment is used.
Figure 10:
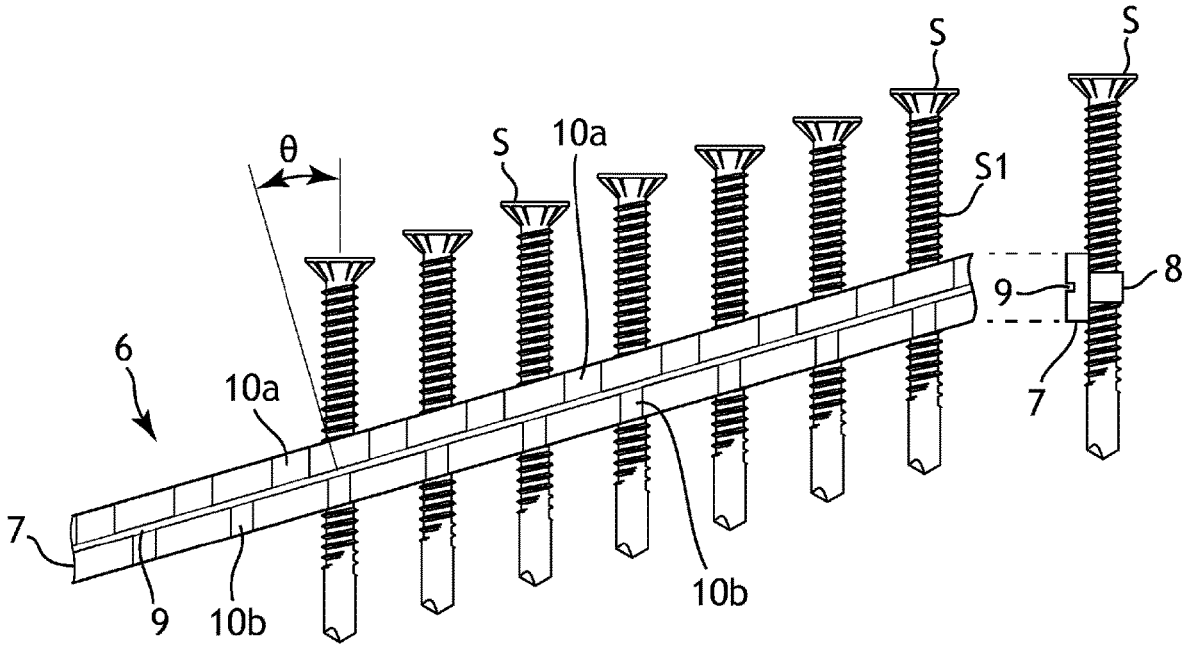
FIG. 10 is schematic plan view and side view illustrating one example of part of the screw rope which holds the screws according to the present embodiment.

A cord holding part 20 for holding a power source cord (not illustrated) for supplying electric power requested for the operation of the successive screw tightening machine 1 is attached to the rear part of the end cover 12 of the grip unit 2 as illustrated in FIG. 2.

The block head 15 includes one pair of left and right guide pole insertion cylinders 15*a* and 15*b* which are juxtaposed and fit on outer circumferences of one pair of corresponding guide poles 21*a* and 21*b* which are interposed between the grip unit 2 and the screw tightening machine body unit 3 so as to be movable upward and downward and also includes a bit insertion cylinder 15*c* which is disposed on an intermediate part between positions under one pair of the guide pole insertion cylinders 15*a* and 15*b* and through which the bit 22 is inserted.

Then, the bit 22 the upper end part of which is held by the grip unit 2 is projected downward and passes through the bit insertion cylinder 15*c* so as to make the lower end side of the bit 22 face the inside of the screw tightening machine body unit 3.

The screw tightening machine body unit 3 includes a box-shaped feeder block 32 which defines its external shape as a main constituent component and makes the leading end part of the bit 22 which is projected from the grip unit 2 and passes through the bit insertion cylinder 15*c* face a tightening action position in the feeder block 32.

One pair of guide pole receiving parts 32*a* and 32*b* to which lower end parts of the one pair of guide poles 21*a* and 21*b* which are inserted into the one pair of the guide pole insertion cylinders 15*a* and 15*b* of the block head 15 of the grip unit 2 and guide the block head 15, that is, downward and upward moving operations of the grip unit 2 are mounted are disposed on an upper surface part of the feeder block 32.

A feed lever manipulator (not illustrated) whose upper end part is coupled with the block head 15 and whose lower end side faces the inside of the screw tightening machine body unit 3 is disposed between the grip unit 2 and the screw tightening machine body unit 3 and is engaged with feed lever, also not illustrated, which configures a screw feeding mechanism part 31 provided on the screw tightening machine body unit 3 such that the downward and upward moving operations of the grip unit 2 are performed in linkage with the operation of the screw feeding mechanism part 31 which will be described below.

In addition, the screw feeding mechanism part 31 which feeds the respective screws S attached to a belt-shaped member 7 of the screw rope 6 which is configured as described later and is supplied from the side part of the screw tightening machine body unit 3 into the tightening action position in linkage with the tightening operation by the screw tightening machine body unit 3 is incorporated into the screw tightening machine body unit 3.

The screw feeding mechanism part 31 includes the feeder block 32 and a guide cover 33 which attaches the screw rope 6 to the front-surface right side of the feeder block 32 such that the position relative to the feeder block 32 is finely adjusted by an adjustment dial 34 in the front-back direction (a depth direction of the feeder block 32) relative to the feeder block 32 thereby to make each screw S pass through a region between the feeder block 32 and the rear surface side of the guide cover 33 together with the screw rope 6 which will be described later and to guide the screw head of each screw S to the tightening action position.

In addition, though description of the detailed structure is omitted, the screw feeding mechanism part 31 includes the feed lever, a grip finger 35 illustrated in FIG. 1. A link mechanism (not illustrated) operates the feed lever manipulator, the feed lever, the grip finger 35 and so forth in linkage with the downward and upward moving operations of the grip unit 2 to thereby perform guiding of each screw S held by the screw rope 6 to the tightening action position, holding of each screw S at the tightening action position and discharging of each empty portion of the screw rope 6 which is configured as described later after termination of the tightening operation.

A screw guide position adjustment mechanism part 41 which includes a screw guide 44 is disposed under the screw tightening machine body unit 3.

That is, the screw guide 44 which makes each screw S to be tightened pass through it and which brings the lower end surface of the screw S into abutment on a surface of the tightening target place to which the screw S is to be tightened is disposed under the screw tightening machine body unit 3.

Then, an adjuster plate 42 which stands upward vertically with its lower end part being coupled with the screw guide 44 is made to face the inside of the feeder block 32 such that positional adjustment of the adjuster plate 42 relative to the feeder block 32 and coupling and decoupling of the adjuster plate 42 to and from the feeder block 32 are made possible by manipulation of an adjust lever 43 provided in the feeder block 32 thereby to adjust the position of the screw guide 44 relative to the screw tightening machine body unit 3 from which the position of the screw guide 44.

Next, the magazine unit 4 which feeds many screws S held by the screw rope 6 which is configured as described later in turn to a place between the feeder block 32 and the guide cover 33 of the screw tightening machine body unit 3 will be briefly described.

The magazine unit 4 is disposed on the rear surface side of the screw tightening machine body unit 3 and includes a bottomed cylindrical magazine body 51 which houses therein the screw rope 6 with many screws S being attached in a state of being wound into a circular coiled shape, a lid element 52 which is made openable and closable so as to cover an opening in the magazine body 51 and a mounting part 53 which is disposed on part of the outer circumference of the magazine body 51 and is configured such that the magazine body 51 and the lid element 52 are integrated with and are freely separated from the screw tightening machine body unit 3 as requested by detachably mounting the mounting part 53 to the rear surface side of the screw tightening machine body unit 3 as illustrated in FIG. 1 to FIG. 3 and FIG. 14.

Further, the magazine body 51 of the magazine unit 4 includes a draw-out port 54 for the screw rope 6 and a magazine side cover 55. Incidentally, the magazine body 51 may also have a configuration that the magazine side cover 55 is not included.

Next, a specific configuration of the screw rope 6 which holds the screws S will be described with reference to FIG. 10 to FIG. 13.

The screw rope 6 according to the present embodiment holds fixed portions of threaded parts S1 of the respective screws S so as to be obliquely disposed at predetermined parallel intervals and at a predetermined inclination angle θ by the square belt-shaped member 7 which runs in the length direction and the binding strips 8 which are disposed on the rear surface side of the belt-shaped member 7 at predetermined intervals.

In the screw rope 6, a groove 9 of a fixed width is continuously formed on the front surface side of the belt-shaped member 7 along the length direction of the belt-shaped member 7. Further, many upper recessed parts 10*a* are disposed in a scattered state and over the entire length of the belt-shaped member 7 at positions above the guide groove 9 and many lower recessed parts 10*b* are disposed in a scattered state and over the entire length of the belt-shaped member 7 at positions under the guide groove 9.

Incidentally, in the present invention, installation positions of the upper recessed parts 10*a* and the lower recessed parts 10*b* are not limited to those in the example illustrated in the drawings, many recessed parts may be disposed in the scattered state and over the entire length of the belt-shaped member 7 at a position or positions other than above and/or under the guide groove 9 in the length direction of the belt-shaped member 7 on the front surface side of the belt-shaped member 7 of the screw rope 6.

That is, the belt-shaped member 7 is formed into a roughly recessed shape in section (or end face).

The above-mentioned upper recessed parts 10*a* and lower recessed parts 10*b* are provided in order to adjust the bending balance of the screw rope 6 and the coiled shape of the screw rope 6 and either of them or both of them may be provided in the screw rope 6. However, as described later, it is found that more favorable bendability is obtained in a case where both of the upper recessed parts 10*a* and lower recessed parts 10*b* are provided than in other cases as described later.

Next, the feeder block 32 and the guide lever 33 which configure the screw feeding mechanism part 31 of the screw tightening machine body unit 3 will be described in more detail with reference to FIG. 4 to FIG. 9.

The guide cover 33 includes a circular stepped cam 36 on its front upper part and is configured so as to finely adjust the position in the front-back direction (the thickness direction of the feeder block 32) relative to the feeder block 32 and thereby to adjust a gap dimension of a passing area for the screw rope 6 between the feeder block 32 and the guide cover 33 by mounting the adjustment dial 34 to the circular stepped cam 36 and rotationally operating the adjustment dial 34.

In addition, a guide projection part 37 which is formed into an inclined shape (the inclination angle θ) which lowers toward the side of a sending destination of the screw rope 6, engages with the guide groove 9 in the belt-shaped member 7 and guides the screw rope 6 in an inclined state and one pair of guide cover recessed parts 38*a* and 38*b* which are formed on both of the upper and lower sides of the guide projection part 37 also at the inclination angle θ are disposed on a wall surface of the guide cover 33 on the side along which the screw rope 6 is guided.

Then, the screw tightening machine body unit 3 is configured to guide the screw rope 6 which holds the screws S is guided in the inclined state in a state where the guide projection part 37 is engaged with the guide groove 9 in the belt-shaped member 7 and one pair of projected areas on the front surface side of the belt-shaped member 7 on the both sides of the guide groove 9 are respectively fitted into the one pair of the guide cover recessed parts 38*a* and 38*b*.

Figure 15:
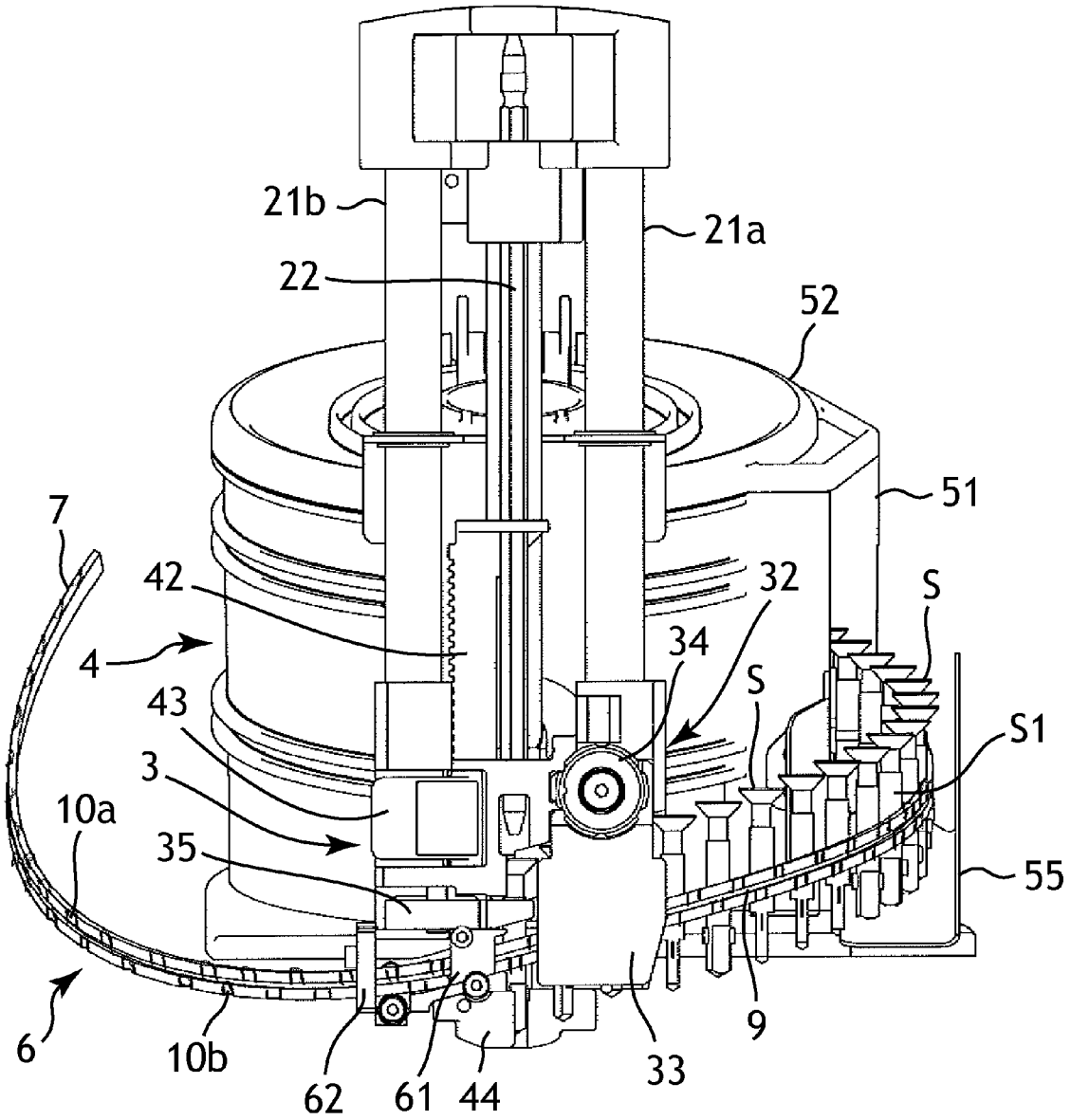
FIG. 15 is a partial enlarged perspective view illustrating one example of a state where the screw rope according to the present embodiment is fed into and discharged from a tightening action position by the screw tightening machine body unit of the successive screw tightening machine in which the screw rope according to the present embodiment is used.

The screw tightening machine body unit 3 further includes a first empty screw rope guide strip 61 and a second empty screw rope guide strip 62 disposed on the front surface side of the feeder block 32 and on the side ahead of the tightening action position and is configured to guide each portion (each empty portion) of the screw rope 6 from which each screw S is detached after termination of the tightening operation by the first empty screw rope guide strip 61 and the second empty screw rope guide strip 62 and discharge each empty portion to the lateral side of the screw tightening machine body unit 3 as illustrated in FIG. 15.

Next, operational effects of the screw rope 6 according to the present embodiment and the successive screw tightening machine 1 using the screw rope 6 will be described by targeting mainly on the operational effect of the screw rope 6 itself, guiding of each screw S to the tightening action position by the successive screw tightening machine 1 when using the screw rope 6 and an operation of discharging the screw rope 6 with reference to FIG. 14.

Figure 11:
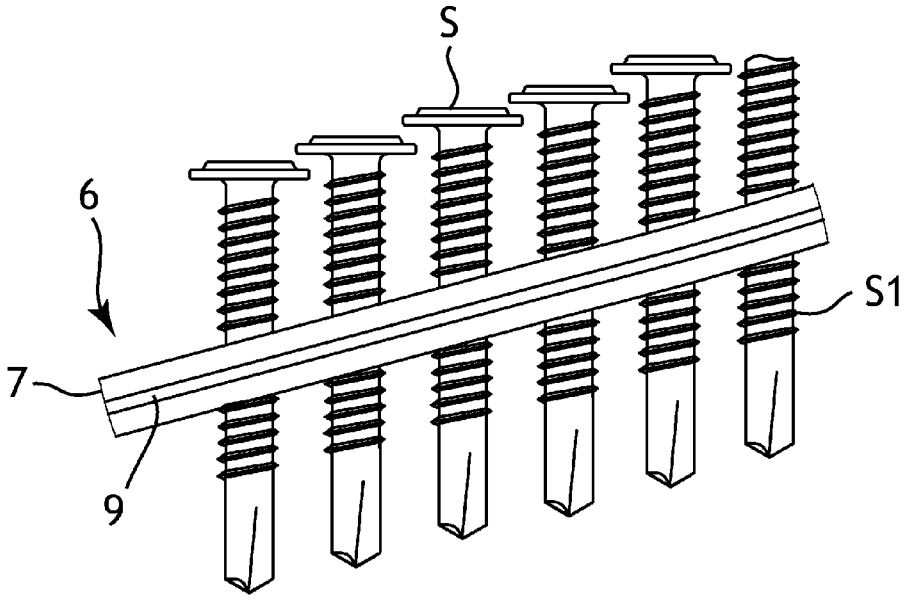
FIG. 11 is a side view illustrating one example of part of the screw rope which holds the screws according to the present embodiment, illustrating an example of a case where screws which are large in head diameter are used.
Figure 12:
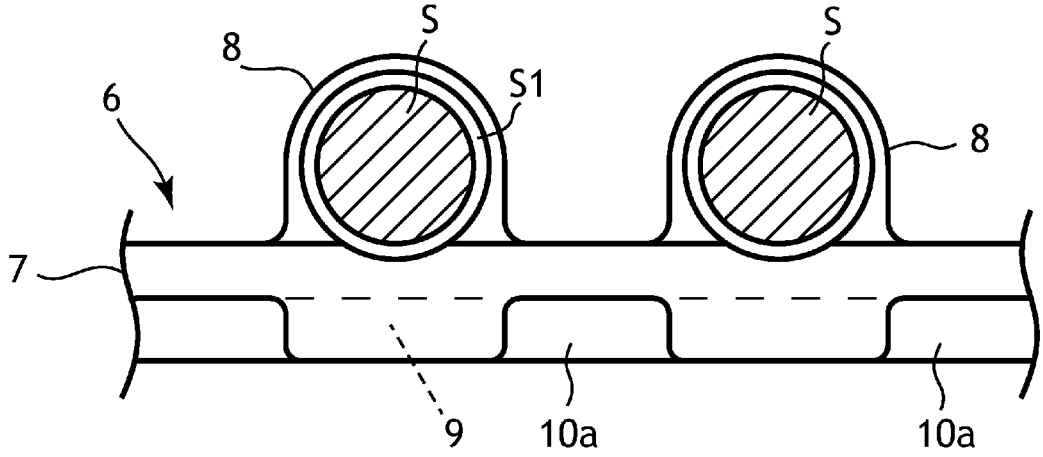
FIG. 12 is a partial enlarged sectional diagram illustrating one example of the screw rope which holds the screws according to the present embodiment, viewed from the upper surface side of the screw rope.
Figure 13:
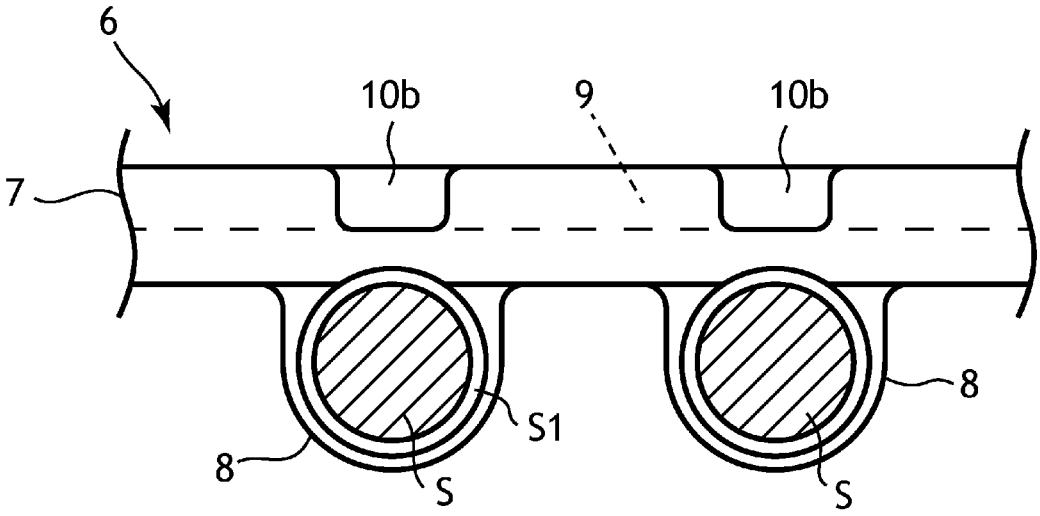
FIG. 13 is a partial enlarged sectional diagram illustrating one example of the screw rope which holds the screws according to the present embodiment, viewed from the lower surface side of the screw rope.

According to the screw rope 6 pertaining to the present embodiment which is configured as mentioned above, even where a screw S has a large head diameter, interference (contact) between heads of the adjacent screws S is eliminated by holding the respective screws S at predetermined parallel intervals so as to be obliquely disposed at the predetermined inclination angle θ. Thus, even where the head diameter of each screw S is more than or equal to, for example, the coupling pitch, it becomes possible to maintain the same coupling pitch of the respective screws Son the screw rope 6 thereby expanding the size selection and kind of screw S used. Where screws having a large head diameter are used, it becomes possible to smoothly use the respective screws S with no interference (contact) between the heads of the adjacent screws S by arranging the respective screws S in a manner that the screw heads mutually overlap as illustrated in FIG. 11.

Figure 14:
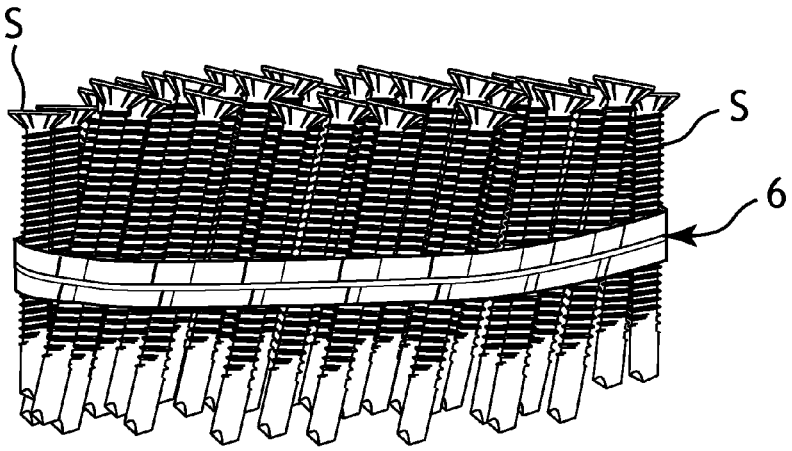
FIG. 14 is a schematic perspective view illustrating one example of a state where the screw rope which holds the screws according to the present embodiment is wound into a coiled shape.

In addition, where the screw rope 6 having the above mentioned configuration that many screws S are successively held according to the present embodiment is wound into the coiled shape as illustrated in FIG. 14, the bending balance between the upper and lower sides of the guide groove 9 when winding the screw rope 6 into the coiled shape becomes favorable by using the screw rope of the type that both of the upper recessed parts 10*a* and the lower recessed part 10*b* are provided on the both sides of the guide groove 9 as mentioned above as the screw rope 6 and consequently it becomes possible to properly house many screws S held by the screw rope 6 in the magazine body 51 in the favorable state as a whole and in the massive shape and to smoothly draw out the screws S through the draw-out port 54.

Further, since the lower recessed parts 10*b* are successively disposed in the scattered state at the positions under the guide groove 9 of the screw rope 6, it is possible to control, for example, bending of the empty rope.

On the other hand, where the screw rope of a structure that the lower recessed parts 10*b* or the upper recessed parts 10*a* are disposed only on the lower side or the upper side of the guide groove 9 is used, in the screw rope 6, the bending balance between the upper side and the lower side of the guide groove 9 become unfavorable, many screws S are gathered together into a conglomeration resembling an inverted or upright V shape in outer appearance making it difficult to appropriately house the screws S in the magazine body 51.

Use of the screw rope such that both upper recessed parts 10*a* and lower recessed parts 10*b* are disposed on the both sides of the guide groove 9 as described above as the screw rope 6 in this way facilitates shape control of the outer edges of many screws S while winding the screw rope 6 itself into the coiled shape.

In addition, according to the successive screw tightening machine 1 using the screw rope 6 according to the present embodiment, only when the screw rope 6 of the above-mentioned configuration is used, it is possible to guide the screws S in turn to the tightening action position in a manner that the height positions of the screw heads of the respective screws S are gradually lowered as they approach the tightening action position side of the bit 22 while keeping the screw rope 6 in the inclined state and keeping each screw S in the vertical state by engagement of the guide projection part 37 of the guide cover 33 with the guide groove 9 in the screw rope 6 and to smoothly discharge the portions from which the screws S are detached in turn to the lateral side of the tightening action position while guiding the portions by the first empty screw rope guide strip 61 and the second empty screw rope guide strip 62 without bringing them into contact with the upper surface of the tightening target place after termination of the operation of tightening each screw S as illustrated in FIG. 14.

Figure 16:
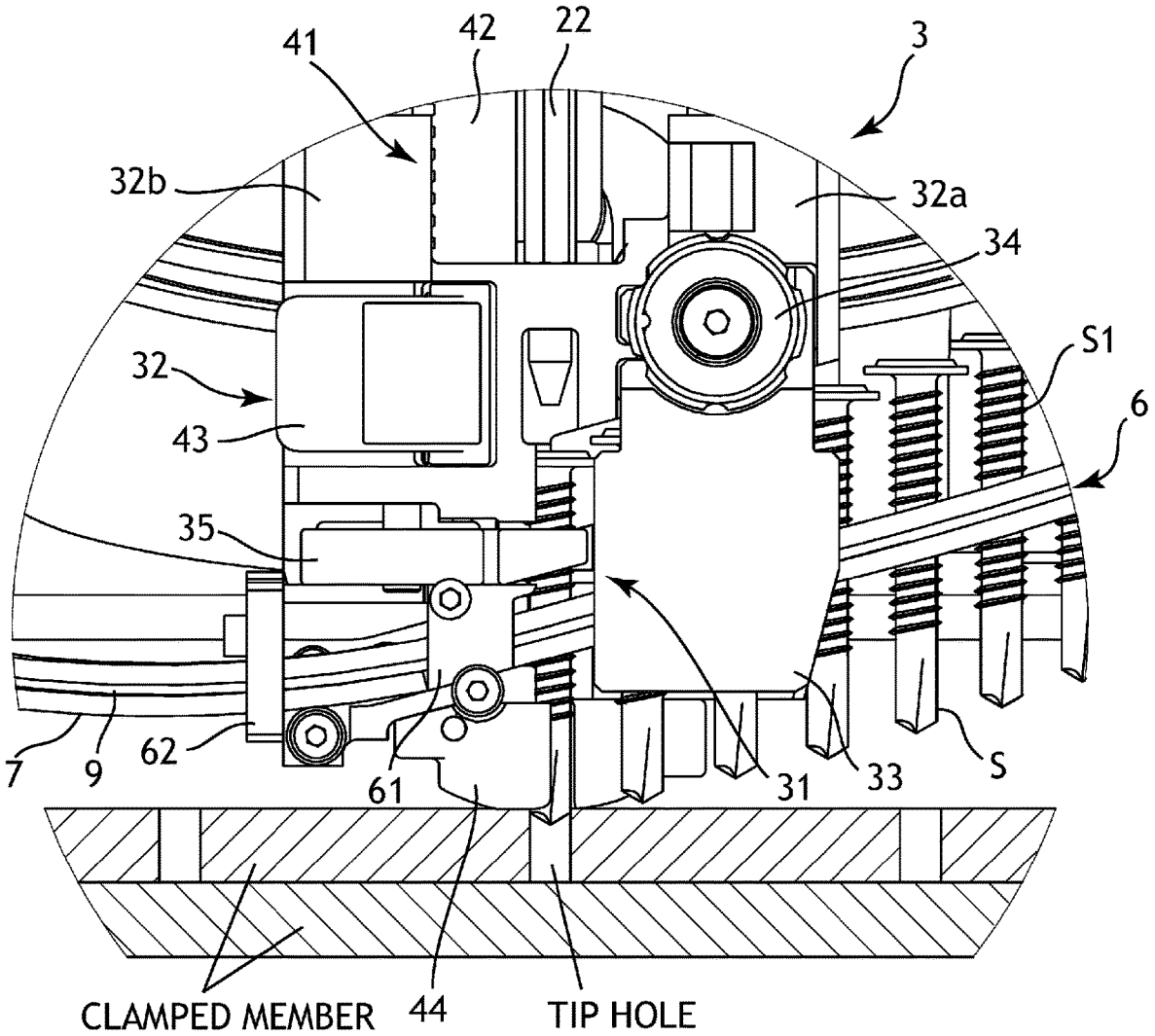
FIG. 16 is a reference diagram illustrating one example of a state where the screw rope is fed into and discharged from the tightening action position by the screw tightening machine main unit of the successive screw tightening machine in which the screw rope according to the present embodiment is used and a state of performing driving targeting on a tip hole position of a tightened member by using the successive screw tightening machine concerned.
Figure 17:
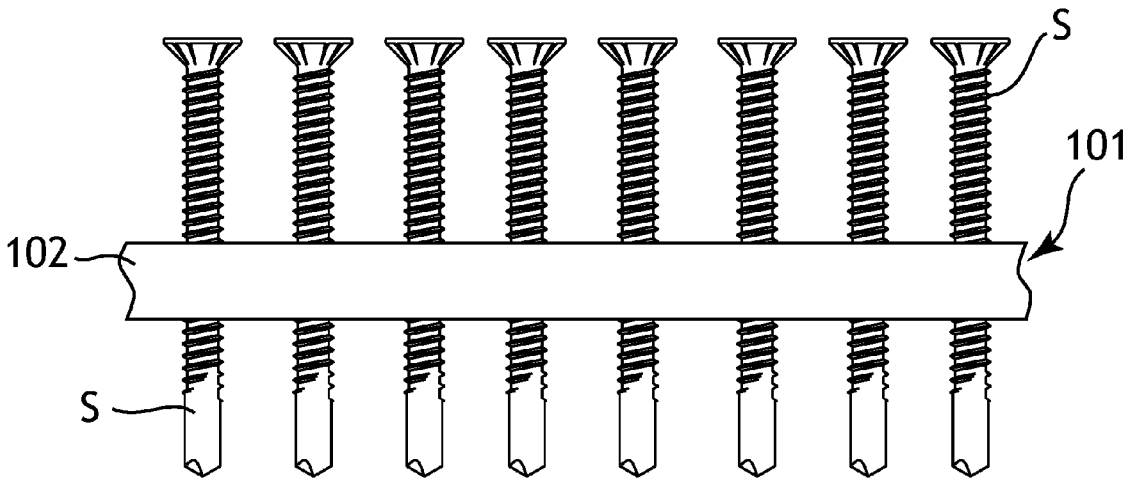
FIG. 17 is a schematic plan view illustrating part of an existing screw rope which holds screws.
Figure 18:
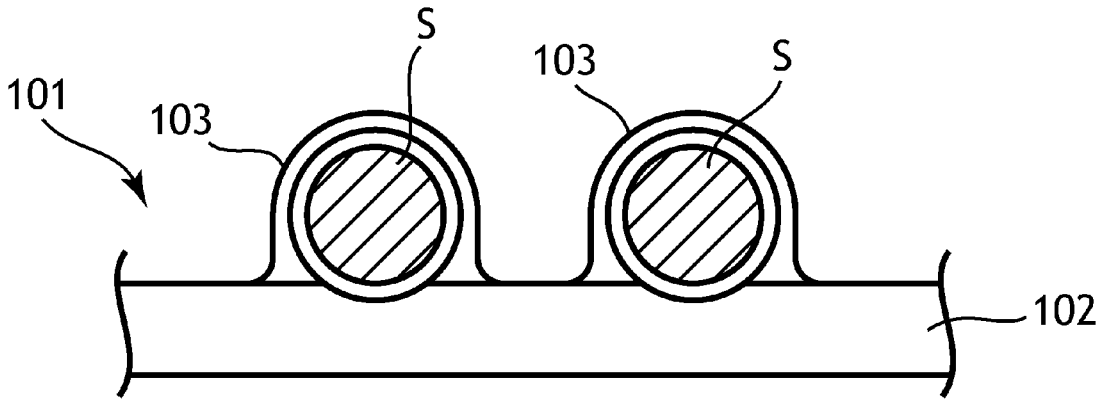
Prior Art Fig. 18
FIG. 18 is a schematic sectional diagram illustrating part of the existing screw rope which holds the screws.

Still further, according to the successive screw tightening machine 1 using the screw rope 6 of the presently described embodiment, targeting drive on, for example, the tip hole position of the tightened member as illustrated in FIG. 16 is enabled.

According to the screw rope 6 pertaining to the present embodiment and the successive screw tightening machine 1 using the screw rope 6, unification of a combination of the successive screw tightening machine 1 with the screw rope 6 and thereby it becomes possible to realize and provide the screw rope 6 which is allowed to be used only in this successive screw tightening machine 1 for certain successive screw tightening work and to realize and provide the successive screw tightening machine 1 which is able to execute the successive screw clamping work only in a case where the screw rope 6 is used.

The screw rope 6 according to the embodiment of the present invention is favorably applicable as the screw rope for use in the successive screw tightening machine applications for structures and construction products such as floor surfaces, truck beds, buildings, houses, ships and so forth.

REFERENCE COMPONENT NUMBERS LIST

1 successive screw tightening machine
2 grip unit
3 screw tightening machine body unit
4 magazine unit
5 handle unit
6 screw rope
7 belt-shaped member
8 binding strip
9 groove
10*a* upper recessed part
10*b* lower recessed part
11 handle cover
12 end cover
13 housing
14*a* first lower cover
14*b* second lower cover
15 block head
15*a* guide pole insertion cylinder
15*b* guide pole insertion cylinder
15*c* bit insertion cylinder
16 trigger switch
17 direction lever
18 handle unit insertion port
19 handle unit lock lever
20 code holding part
21*a* guide pole
21*b* guide pole
22 bit
31 screw feeding mechanism part
32 feeder block
32*a* guide pole receiving part
32*b* guide pole receiving part
33 guide cover
34 adjustment dial
35 grip finger
36 circular stepped cam
37 guide projection part
38*a* guide cover recessed part
38*b* guide cover recessed part
41 screw guide position adjustment mechanism part
42 adjuster plate
43 adjust lever
44 screw guide
51 magazine body
52 lid element
53 mounting part
54 draw-out port
55 magazine side cover
61 first empty screw rope guide strip
62 second empty screw rope guide strip
S screw
S1 threaded part

What is claimed is:

1. A successive screw tightening machine using a screw rope comprising:

a grip unit in which a screw tightening bit is disposed so as to project therefrom, wherein the grip unit rotationally drives the bit by a switch operation employing a clutch, a screw tightening machine body unit with a feeder block disposed on a lateral side of a tightening position such that a leading end of the bit faces the tightening action position, a magazine unit disposed on the screw tightening machine body housing a screw rope, feeding in turn many screws held by the screw rope, wherein the grip unit contains a screw rope guide having a guide cover disposed so as to face the feeder block, wherein the grip unit contains a screw rope guide having a guide cover disposed so as to face the feeder block, wherein the guide cover includes a guide projection part formed in an inclined shape for guidance of the screw rope, wherein the screw rope is configured to hold fixed portions of threaded parts of the respective screws so as to be obliquely disposed at predetermined parallel intervals at a predetermined inclination angle corresponding to an inclination angle of the guide projection part by a belt-shaped member which runs in a length direction and wherein the screw rope includes a guide groove continuously formed on a front surface side of the belt-shaped member along the length direction thereof, and wherein a plurality of upper recessed parts and a plurality of lower recessed parts are alternately disposed on both above and under the guide groove along said length direction and wherein the screw rope has binding strips provided on a rear surface side of the belt-shaped member at predetermined intervals each at a position corresponding to the plurality of the lower recessed parts respectively, and wherein the screw rope is configured such that when the screw rope is used, the screws are guided to the tightening action position in turn in a manner whereby height positions of screw heads of the respective screws are lowered as the screws approach the tightening action position side of the bit while keeping the screw rope in an inclined state and keeping the respective screws in vertical states by engagement of the guide projection part of the guide cover with the guide groove in the screw rope, wherein the upper recessed parts and the lower recessed parts are configured to facilitate shape control of the screws so as to wind the screw rope into a coiled shape.

2. The successive screw tightening machine according to claim 1, wherein the plurality of upper and lower recessed parts are provided over the entire length of the belt-shaped member of the screw rope.

* * * * *